US006435167B1

(12) United States Patent
Finger et al.

(10) Patent No.: US 6,435,167 B1
(45) Date of Patent: Aug. 20, 2002

(54) EXHAUST GAS TURBOCHARGER

(75) Inventors: Helmut Finger, Leinfelden-Echterdingen; Peter Fledersbacher, Stuttgart; Gernot Hertweck, Fellbach; Siegfried Sumser, Stuttgart; Friedrich Wirbeleit, Esslingen, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/721,746

(22) Filed: Nov. 27, 2000

(30) Foreign Application Priority Data

Nov. 26, 1999 (DE) ..... 199 56 896

(51) Int. Cl.[7] ..... F02M 25/07; F02B 37/12

(52) U.S. Cl. ..... 123/568.12; 60/602; 60/605.2; 415/160

(58) Field of Search ..... 60/602, 605.2; 415/146, 164, 160, 159; 123/568.12, 568.21

(56) References Cited

U.S. PATENT DOCUMENTS

| | | | | |
|---|---|---|---|---|
| 4,499,732 A | * | 2/1985 | Szczupak et al. | 60/602 |
| 5,372,485 A | | 12/1994 | Sumser et al. | 417/407 |
| 5,406,796 A | | 4/1995 | Hiereth et al. | 60/605.2 |
| 5,452,986 A | | 9/1995 | Osborne et al. | 415/165 |
| 5,461,860 A | | 10/1995 | Schegk | 60/611 |
| 5,498,128 A | * | 3/1996 | Baets et al. | 415/164 |
| 5,518,365 A | * | 5/1996 | Baets et al. | 415/164 |
| 5,855,117 A | | 1/1999 | Sumser et al. | 60/602 |
| 5,868,552 A | * | 2/1999 | McKean et al. | 415/158 |
| 6,168,375 B1 | * | 1/2001 | LaRue et al. | 415/146 |

FOREIGN PATENT DOCUMENTS

| | | |
|---|---|---|
| DE | 31 51 414 | 5/1983 |
| DE | 43 12 078 | 10/1994 |
| DE | 43 34 466 | 4/1995 |
| DE | 195 48 852 | 7/1997 |
| DE | 196 51 498 | 4/1998 |
| EP | 0 598 174 | 5/1994 |

* cited by examiner

*Primary Examiner*—Willis R. Wolfe
(74) *Attorney, Agent, or Firm*—Crowell & Moring LLP

(57) ABSTRACT

An exhaust gas turbocharger with an exhaust gas turbine and a radial compressor includes an impeller which pumps air through guide vanes or wedge guide elements into a helical passage. It is proposed that the guide vanes or wedge vane elements be guided for axial displacement in the casing of the radial compressor and be able to be shifted across the pumped stream of the impeller.

19 Claims, 3 Drawing Sheets

EXHAUST GAS TURBOCHARGER

BACKGROUND AND SUMMARY OF THE INVENTION

This application claims the priority of 199 56 896.0, filed in Germany, Nov. 26, 1999, the disclosure of which is expressly incorporated by reference herein.

The invention relates to an exhaust gas turbocharger and a radial compressor whose vane wheel drives air through guide vanes into a diffuser channel.

Exhaust gas turbochargers are used both on autoignition internal combustion piston engines with quality control as well as on external ignition internal combustion piston engines with quality control in order to increase power or improve exhaust quality by improving cylinder charging with compressed air and increasing the expansion energy of the combustion gases.

Exhaust gas turbochargers are proven auxiliary units of simple construction and long useful life. They include as a rule an exhaust gas turbine with a constant blade geometry driving a rotary compressor with a radial blade geometry. While the exhaust gas turbine cooperates well as a flow machine with the rotary compressor, the two units combined as a turbocharger have different operating characteristics from those of an internal combustion piston engine and can be adapted only with difficulty to the needs of the internal combustion piston engine. If the exhaust gas turbocharger is designed for the nominal point of the internal combustion piston engine, the pumping pressure in the lower rotary speed range is insufficient on account of the relatively large exhaust gas turbine. If, however, the exhaust gas turbocharger is designed for a partial-load point of the internal combustion piston engine, the turbine is too small at the nominal power point. This results in considerable losses of efficiency.

It is known to drive the rotary compressor mechanically in the lower speed range of the internal combustion piston engine, in addition to the exhaust gas turbine, by an electric motor or a gas turbine, or to apply the combustion gases of a combustion chamber additionally to the exhaust gas turbine. These solutions call for a great amount of construction and control.

Exhaust gas turbochargers with a variable blade geometry are also known. European Patent Document EP 0 598 174 A1 describes an exhaust gas turbocharger for an internal combustion engine, whose exhaust gas turbine has a rotor which is surrounded by a guiding means with a volute. The latter has an annular nozzle-like mouth area in which a variable baffle grid with guiding vanes is disposed. With the internal combustion engine running at full load, the passages through the baffle grid are partially opened, while for the engine running at a diminishing partial load the passages through the baffle grid are increasingly opened by rotating a portion of the baffle. If the turbine baffle grid is closed with the engine in the partial load range the speed of the exhaust gas turbine can be maintained at a high level despite the reduced mass flow. The performance graph available on the side of the exhaust gas turbine of the turbocharger is broadened through the variation of the baffle grid. Still, the performance graph of the turbocompressor with constant vane geometry remains basically unchanged.

An exhaust gas turbine for an internal combustion engine is disclosed in German Patent Document DE 196 51 498 C1. The turbine housing is provided with an axial slide which has a baffle grid with guiding vanes and is carried in an annular gap between the turbine casing and an inner guide.

A radial annular space is provided to connect the flow between a rotor of the turbine and the turbine casing. In a retracted position, in which the radial annular space is free of the baffle grid, the axial slide frees an outlet opening into an exhaust gas passage. The baffle grid serves to extend the exhaust gas turbine performance graph to lower mass flows.

Exhaust gas turbochargers with a variable blade geometry are also known. European Patent Document EP 0 598 174 describes an exhaust turbocharger for an internal combustion engine, whose exhaust turbine has a runner wheel which is surrounded by a guiding apparatus with a spiral-shaped guiding passage which is swept at least partially diagonally. This passage has an annular-shaped mouth area in which a variable guide grid with guide blades is disposed. When the internal combustion engine is at full load the cross sections of the guide grid are partially opened, while for a diminishing partial-load operation of the internal combustion engine the cross sections of the guide grid are increasingly opened by the rotation of a portion of the guide grid. If the turbine guide grid is closed in the partial-load range of the internal combustion engine the speed of the exhaust turbine can be kept at a high level in spite of the reduced mass flow. The available characteristic chart on the side of the exhaust turbine of the turbocharger is broadened through the guide grid variation. of course, the characteristic chart of the radial compressor of constant blade geometry remains basically unchanged.

An exhaust gas turbine for an internal combustion engine has been disclosed in German Patent Document DE 31 51 414 A1. A radial annular space is provided to connect the flow between a spiral channel in the turbine casing and a runner wheel of the turbine. In the turbine casing a baffle grid with guide vanes is provided, which are axially displaceable by pistons against the force of a return spring and reach into the annular space across the direction of flow of the exhaust gas. The baffle grid is displaceable to two positions, namely to a first position in which it reaches through the annular space such that its inner faces lies against the inside wall of the annular space, and to a second position in which is retracts into an annular chamber adjoining the annular space and its inner lateral faces form flush portions of the inner wall of the annular space. The baffle grid serves to extend the exhaust gas turbine characteristic to lower mass flows.

To be able to make the best use of the advantage on the side of the exhaust gas turbine it is necessary to go all the way to the limits of the performance graph of the rotary compressor, which are determined by the pumping limit and the plugging limit of the compressor. The term, "pumping," in rotary compressors, is understood to be a back flow of the compressed gaseous medium from a reserve volume on the discharge end of the rotary compressor when the mass flow through the rotary compressor decreases to the extent that the rotary compressor can no longer produce the necessary discharge pressure against the reserve pressure. If the pressure on the discharge end of the rotary compressor has dropped due to the back flow to the extent that the rotary compressor again delivers a corresponding discharge pressure, the pumping in the pumping direction resumes until the reservoir has charged up again and the pumping process is repeated. The "pumping" leads to great mechanical stresses on the exhaust gas turbocharger and entails a noise bothersome to the driver.

What impresses the driver of a vehicle more than the maximum torque and power is the spontaneity of the reaction to gas pedal movement and—especially in the case of supercharged internal combustion engines—the build-up of torque when accelerating from low engine rpm. Since the speed of torque build-up depends on how fast the charging pressure builds up, exhaust gas turbochargers with a variable blade geometry can be used to advantage on the exhaust gas turbine side by largely closing the blades when an acceleration from the partial load range begins so that the exhaust gas turbine accelerates very greatly.

Although a sufficient distance from the pumping limit of the rotary compressor is maintained when idling, pumping can occur briefly when driving. This danger exists especially when the driver of the vehicle, when driving with a high compressor pressure ratio, abruptly backs off the gas pedal and the speed of the internal combustion engine rapidly decreases, e.g., in the case of vehicles with hydrodynamic clutches or torque converters, or in the case of shifting with interruption of the pulling effort.

Definite progress has been made in regard to the breadth of the compressor performance graph by curving the blades backward at the exit area of the rotor. Also, in the case of utility vehicles, special casing configurations have been used in order to shift the pumping limit toward low mass flows. A decided influence on the operating characteristic of the radial compressor is the design of the diffuser following the rotor, the purpose of which is to convert the kinetic energy of the flow issuing from the rotor to static pressure or potential energy with the lowest possible losses. This slowing of the absolute exit velocity from the rotor can be accomplished by either a blade-less or bladed diffuser.

In the case of a bladed diffuser, a baffle grid is arranged between the rotor and the volute, and has guide vanes exerting forces on the flowing medium and permitting a greater slowing of the circumferential component of the velocity of flow than can be achieved by only increasing the radius on the basis of the twist rate in the unbladed diffuser.

A bladed diffuser with a rigid blade geometry, however, can be given an optimum design only for one particular attack angle. For example, if the mass flow changes at constant compressor speed, the flow angle at the rotor outlet also changes. Flow against the diffuser at a wrong angle results in shock losses and the efficiency losses which they entail. The peak efficiency achievable with a bladed diffuser is therefore higher, but it also breaks in more quickly and significantly when the mass throughput changes than with an unbladed diffuser. Furthermore, it is possible to have a definite influence on the locus of the pumping limit by the design of the bladed diffuser. But since for the above reasons the breadth of the characteristic plays a decisive role in turbocharger compressors, unbladed diffusers are used as a rule which permit an overall broader characteristic.

An exhaust gas turbocharger with a radial compressor is disclosed in DE 195 48 852. To improve the characteristic of the compressor, the blades on the inlet side have a connecting passage between the discharge side and the intake side.

Also disclosed in DE 43 34 466 A1 (corresponding U.S. Pat. No. 5,461,860) is a radial compressor with a bladed diffuser, wherein auxiliary air can be fed to the baffle grid on the inlet side.

U.S. Pat. No. 5,452,986 has disclosed a radial compressor with a vaned spiral channel wherein guide vanes fastened on an annular piston are axially displaceable and can be pushed across the direction of the pumped air into the spiral channel. The guide vanes, which are carried in circular, rotatable matrix disks in the compressor casing, have a different vane geometry over their length, so that different upstream and downstream angles result, according to the depth of insertion of the guide vanes passing through the spiral chamber.

Lastly, DE 43 12 078 A1 (corresponding U.S. Pat. No. 5,406,796) discloses an exhaust gas turbocharger which has a radial compressor with an unbladed diffuser. Exhaust gas can be fed into the diffuser through an exhaust gas return line from the casing of the exhaust gas turbine through a regulating valve. Since an exhaust gas return is possible only when the exhaust gas pressure is greater at the inlet of the exhaust gas turbine than the charging pressure at the outlet of the radial compressor, the baffle grid on the exhaust gas turbine must be closed greatly so that the characteristic of the radial compressor shifts further toward the pumping limit. The radial compressor runs in this case in an area of the performance chart where the efficiency is relatively poor. High exhaust gas return rates therefore result in a break in the air ratio.

The invention is addressed to the problem of improving the breadth of the characteristic chart and the performance of the radial compressor. This problem is solved according to the invention by an exhaust gas turbocharger with an exhaust gas turbine and a radial compressor whose vane wheel drives air through guide vanes into a diffuser channel, wherein the guide vanes are axially displaceable in a casing of the radial compressor and can be shifted transversely to a stream pumped by the vane wheel, wherein the guide vanes are deployed at low mass flows and are retracted at high mass flows, and wherein, at working points which can be operated both with guide vanes and without guide vanes, the guide vanes are so actuated that the better efficiency and/or the better compressor pressure ratio is achieved for the particular working point.

Further advantageous features of preferred embodiments of the invention are described herein and in the claims.

According to the invention the guide vanes are axially displaceable in the casing of the radial compressor and can be adjusted across the flow pumped by the impeller. Setting out from the knowledge that the compressor performance can be greatly affected by the design of the diffuser, it is a basic idea of this invention to be able to shift between a configuration of a radial compressor with unbladed diffuser and a configuration with a bladed diffuser in order to shift the pumping limit towards lower mass flow. To be practical, an electronic control unit operates the device for setting the blades on the basis of working parameters, e.g., motor parameters, position of the accelerator pedal, actuating parameters, ambient parameters, variation of the parameters over time, and the like. The guide blades are engaged at low mass flows and retracted at high mass flows. At operating points which can be run both with guide vanes and without guide vanes it is expedient to operate the guide vanes such that, for the particular operating point the better efficiency and/or the better compressor pressure ratio is achieved. The exhaust gas turbocharger according to the invention thus offers the possibility on the one hand of shifting the pumping limit toward lower mass flows and on the other hand of optimizing the efficiency as well as the pressure ratio in the chart area of the radial compressor with respect to the exhaust gas recycling.

It is practical to connect the guide blades at one end to a guide ring of an adjusting device to form a baffle grid, while they are guided on the other face end in a matrix with a narrow sealing gap. To avoid disturbing the flow in the adjacent channel between the impeller and the diffuser it is desirable that in their retracted position the guide blades be flush at their other end with through-openings in the matrix. To couple the guide blades more stably to one another and prevent vibration, it may be desirable to connect the guide blades together at their other end with a cover plate which, when the guide blades enter into their end positions in recesses in the casing or matrix, will be flush with the passage.

Additional advantages will be found in the following description and drawing. In the drawing an embodiment of the invention is represented. The description and the claims contain numerous features in combination. The person of ordinary skill in the art will consider each of the features by itself and combine them into practical additional combinations.

Other objects, advantages and novel features of the present invention will become apparent from the following detailed description of the invention when considered in conjunction with the accompanying drawings.

DETAILED DESCRIPTION OF THE INVENTION

Figure 1:
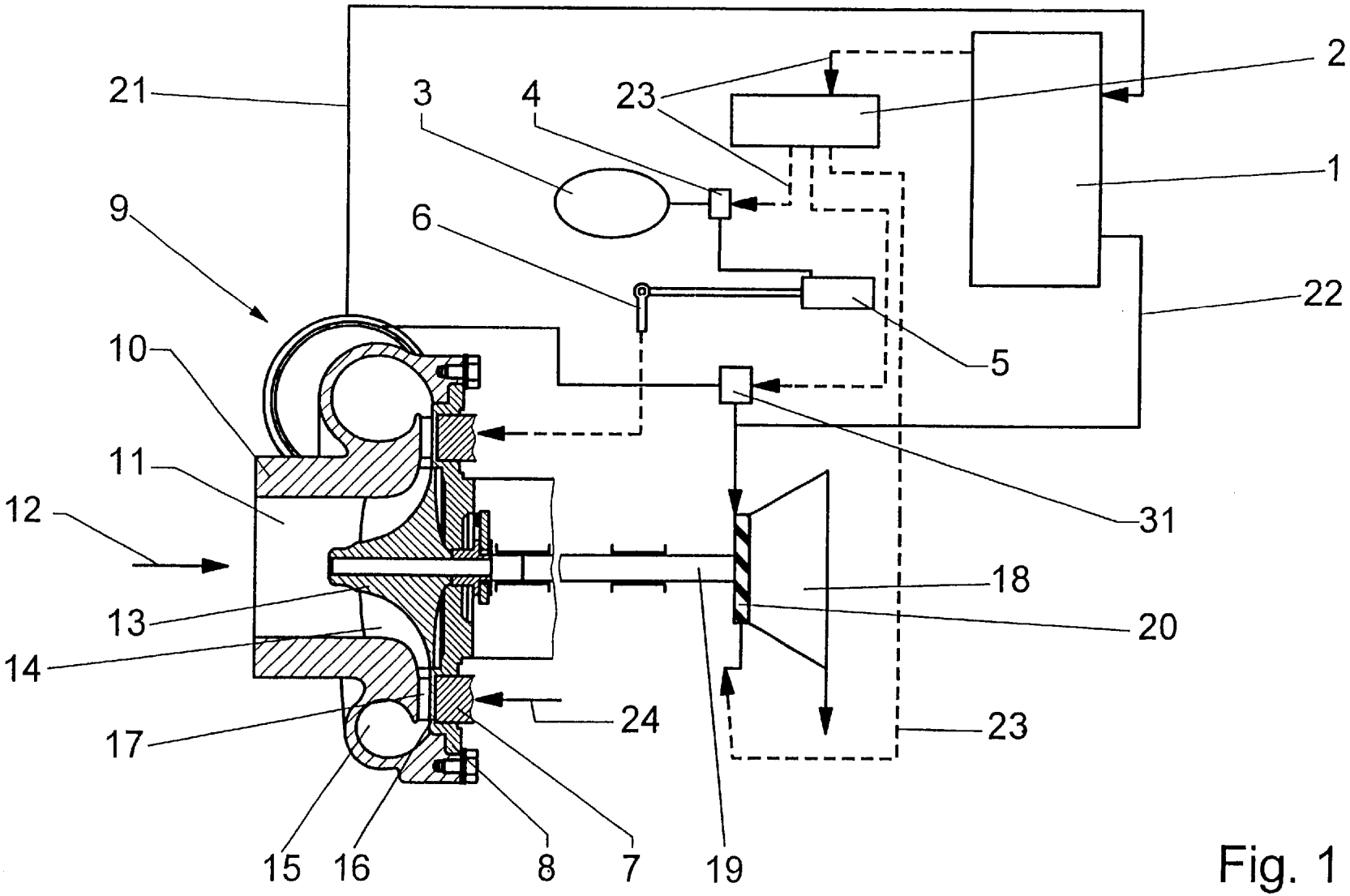
FIG. 1 is a schematically represented internal combustion piston engine with an exhaust gas turbocharger, constructed according to a preferred embodiment of the invention.

An internal combustion engine 1 is connected through a charging air duct 21 with a radial compressor 9 and through an exhaust gas duct 22 to an exhaust gas turbine 18. The exhaust gas turbine 18 has a controllable baffle grid 20 which is increasingly closed at lower exhaust gas flows in order to increase the width of the performance characteristic of the exhaust gas turbine 18 for lower throughputs. Also, the baffle grid 20 can be used for braking since a greater exhaust gas back pressure is produced in the exhaust duct 22 when the baffle grid 20 is relatively greatly closed. Through a shaft 19 the exhaust gas turbine 18 drives an impeller 13 with blades 14 in the radial compressor 9, which aspirates air in direction 12 through an inlet 11 in the casing 10 and drives charging air through a diffuser passage 32 and a helical passage 15 into the charging air line 21. Depending on working parameters of the internal combustion engine 1, the charging air can be mixed through an exhaust gas return device 31 with exhaust gas from the exhaust gas duct 22.

The radial compressor 9 has axially displaceable guide vanes 17 which can be pushed laterally through a matrix 16 into the open diffuser passage 32. For this purpose the guide vanes 17 or in some cases wedge vane elements are connected at one end face by a guiding ring 7 to a baffle grid. The guiding ring 7 is operated through a linkage 6 of an actuator 5. The actuator 5 is operated from a compressed-air source 3 to which it is connected through an electrically controlled valve 4. A central electronic control unit 2, which desirably includes a microprocessor, operates the control valve 4 through signal lines 23 in accordance with driving and operating parameters, and thereby controls the engagement of the guide vanes 17 of the radial compressor, the baffle grid 20 of the exhaust gas turbine 18 and the exhaust gas feed-back system 31.

Figure 2:
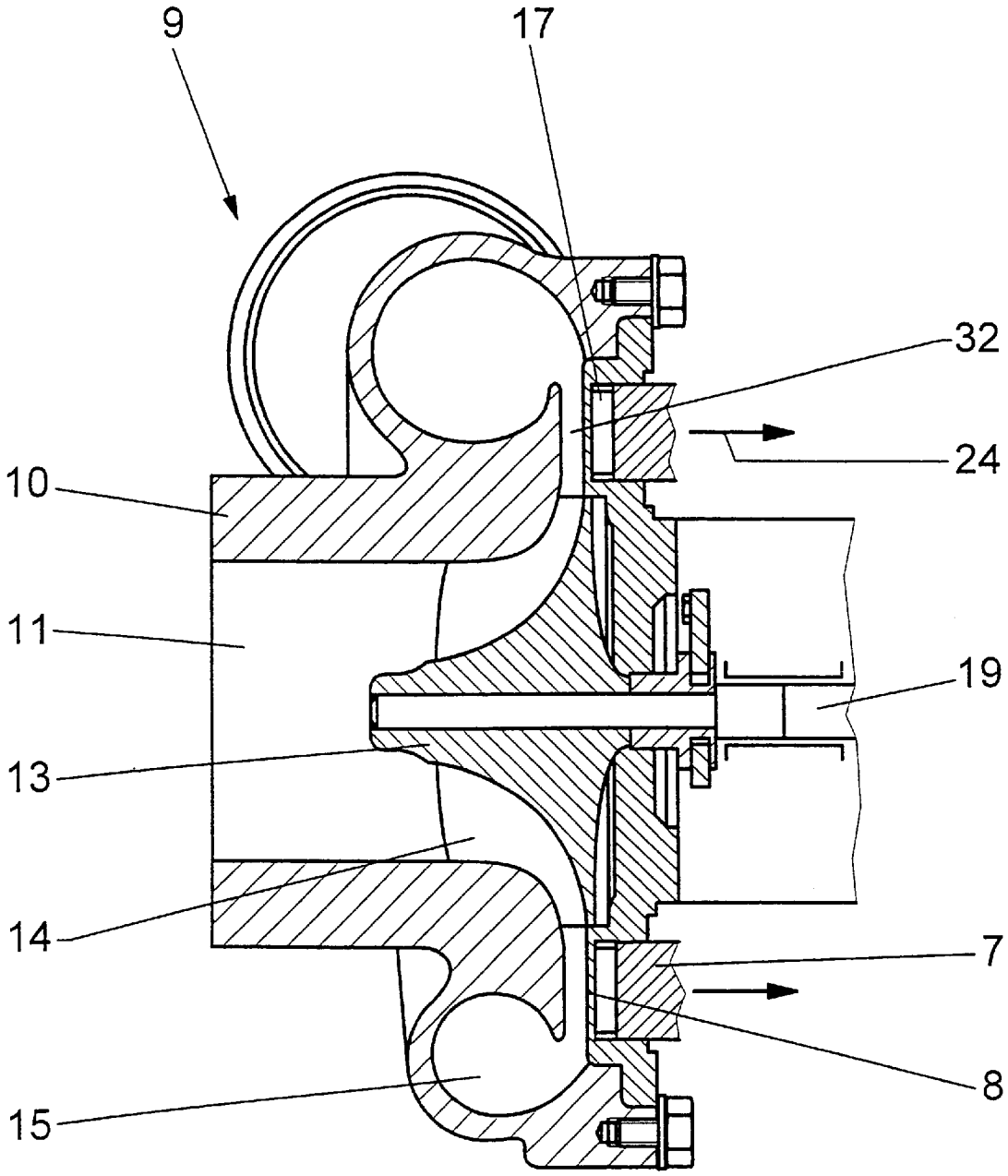
FIG. 2 is a sectional view of a radial compressor as in FIG. 1, on a larger scale with the blades retracted.

The arrow 24 indicates the direction of engagement of the guide vanes 17. FIG. 1 shows the guide vanes 17 in the engaged position, while FIG. 2 shows them in the withdrawn position, so that the diffuser passage 32 is free of guide vanes 17.

Figure 3:
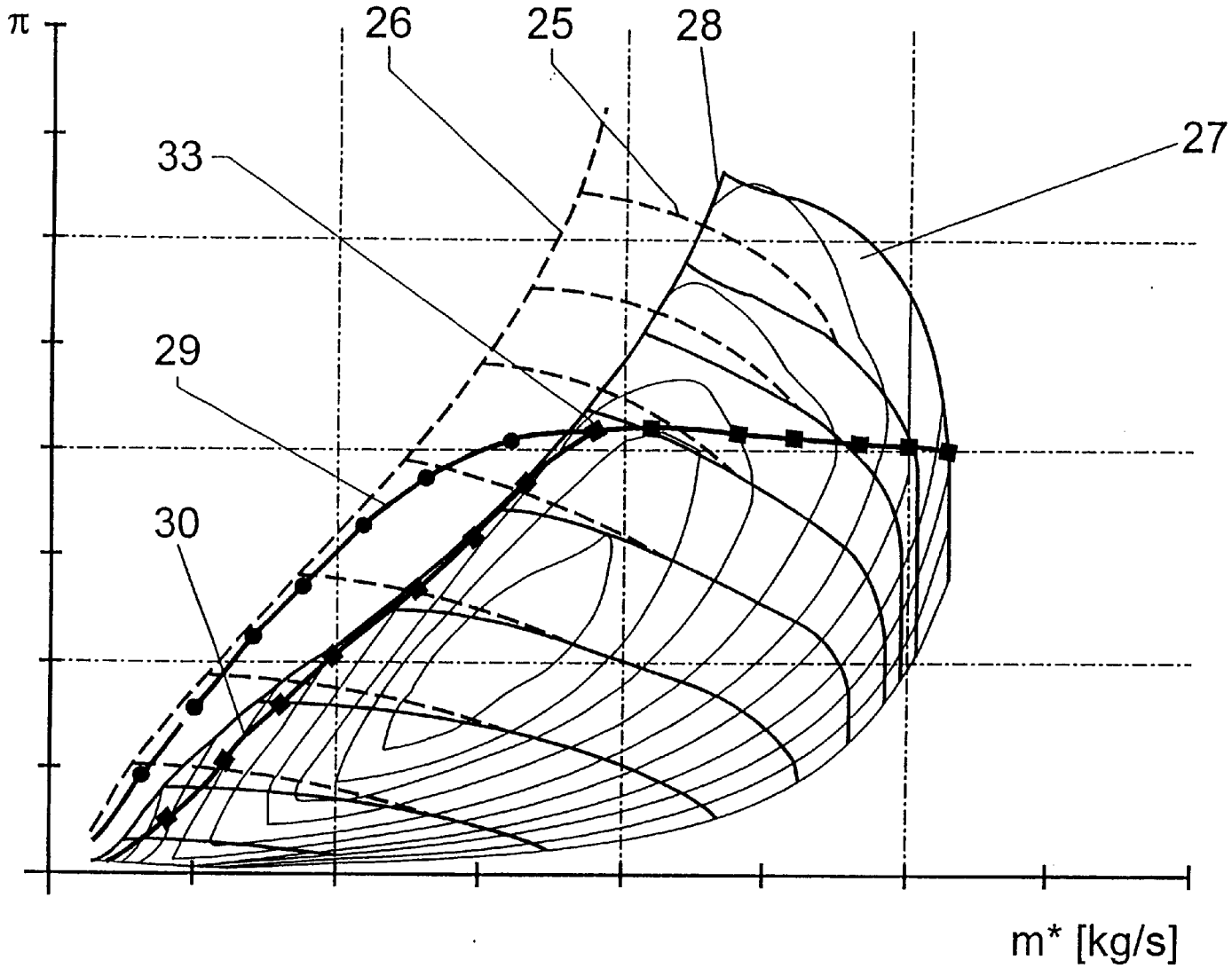
FIG. 3 is a graph with a diagram of the radial compressor operation with the engaged and withdrawn blades.

FIG. 3 shows a chart in which the ratio n of the pressure behind the radial compressor 9 to the pressure ahead of the radial compressor 9 is plotted. A performance graph 27 is shown in solid lines for the radial compressor 9 with the guide vanes 17 retracted as in FIG. 2, and a performance graph 25 is shown in broken lines for the radial compressor 9 with the guide vanes 27 engaged. A pumping limit 26 belongs to performance graph 25, while the pumping limit 28 belongs to performance graph 27. The radial compressor 9 can be driven without guide vanes 17 up to a working line 30. If it is to be operated in the smaller mass flow area m* left of the working line 30, the guide vanes 17 are engaged at shift point 33, so that the radial compressor 9 can be operated up to working line 29. In the area to the right of the working line 30, in which the radial compressor 9 can be operated either with guide vanes 17 or without guide vanes 17, the guide vanes 17 are operated such that, for the particular working point, the better efficiency and/or the better compressor pressure ratio n is reached.

During the acceleration phase the baffle grid 20 of the exhaust gas turbine 18 can be closed only until the radial compressor 9 reaches the pumping limit 26 or 28. In the exhaust gas turbocharger of the invention, the pumping limit 26 with the guide vanes 27 engaged is shifted toward lower mass flows, so that the working line 29 is possible with corresponding advantages with regard to the charging pressure and the response.

If during the slowing phase of the internal combustion engine 1 the baffle grid 20 of the exhaust gas turbine 18 cannot be opened fast enough, the rotatory speed of the exhaust gas turbine 18 decreases too slowly in relation to the speed of the internal combustion engine 1, and the radial compressor 9 can start pumping. Since in the exhaust gas turbocharger of the invention the pumping limit 26 is shifted leftward to smaller mass flows the danger of pumping is reduced. Also, in the case of an exhaust gas return the baffle grid 20 of the exhaust gas turbine 18 can be closed relatively greatly without causing the operating performance of the motor to exceed the pumping limit 26 of the radial compressor 9.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. A vehicle drive assembly including a combustion engine and an exhaust gas driven turbocharger operable to charge combustion air supplied to the engine, said turbocharger comprising:

an exhaust gas driven turbine, a radial compressor drivingly connected to the turbine and including a compressor vane wheel operable to drive engine charging air through a diffuser channel, guide vanes disposed to guide flow from the vane wheel, wherein said guide vanes are axially displaceable in a casing of the compressor between a deployed position in the flow and a retracted position.

2. A vehicle drive assembly according to claim 1, wherein an electronic control unit controls an actuator for axially displacing the guide vanes according to driving parameters.

3. A vehicle drive assembly according to claim 1, comprising electronic control means operable to control the axial position of the vanes as a function of engine operating parameters, with said vanes being deployed at low air mass flows from the vane wheel and being retracted at high mass flows from the vane wheel.

4. A vehicle drive assembly according to claim 1, wherein the guide vanes are joined at one end to a guiding ring of a shifting device and on the other end to a matrix with a narrow sealing gap and at this end are joined together by a cover plate which in an end position of the guide vanes enters into recesses in the casing and a matrix and is flush with a free diffuser passage.

5. A vehicle drive assembly according to claim 4, wherein the guide vanes with their other end face are flush in their withdrawn position with passage openings in the matrix.

6. Exhaust gas turbocharger with an exhaust gas turbine and a radial compressor whose vane wheel drives air through guide vanes into a diffuser channel, wherein the guide vanes are axially displaceable in a casing of the radial compressor and can be shifted transversely to a stream pumped by the vane wheel, wherein the guide vanes are deployed at low mass flows and are retracted at high mass flows, and wherein, at working points which can be operated both with guide vanes and without guide vanes, the guide vanes are so actuated that the better efficiency and/or the better compressor pressure ratio is achieved for the particular working point.

7. Exhaust gas turbocharger according to claim 6, wherein exhaust gas can be fed through an exhaust gas return device to the pressure side of the radial compressor.

8. Exhaust gas turbocharger according to claim 6, wherein an electronic control unit controls an actuator for axially displacing the guide vanes according to driving parameters.

9. Exhaust gas turbocharger according to claim 8, wherein exhaust gas can be fed through an exhaust gas return device to the pressure side of the radial compressor.

10. Exhaust gas turbocharger of claim 6, wherein the guide vanes are joined at one end to a guiding ring of a shifting device and on the other end to a matrix with a narrow sealing gap and at this end are joined together by a cover plate which in an end position of the guide vanes enters into recesses in the casing and a matrix and is flush with a free diffuser passage.

11. Exhaust gas turbocharger according to claim 10, wherein exhaust gas can be fed through an exhaust gas return device to the pressure side of the radial compressor.

12. Exhaust gas turbocharger according to claim 10, wherein an electronic control unit controls an actuator for axially displacing the guide vanes according to driving parameters.

13. Exhaust gas turbocharger according to claim 12, wherein the vanes are adapted to either fully enter into the free diffuser passage or leave it completely open.

14. Exhaust gas turbocharger according to claim 10, wherein the vanes are adapted to either fully enter into the free diffuser passage or leave it completely open.

15. Exhaust gas turbocharger according to claim 14, wherein exhaust gas can be fed through an exhaust gas return device to the pressure side of the radial compressor.

16. Exhaust gas turbocharger according to claim 10, wherein the guide vanes with their other end face are flush in their withdrawn position with passage openings in the matrix.

17. Exhaust gas turbocharger according to claim 16, wherein an electronic control unit controls an actuator for axially displacing the guide vanes according to driving parameters.

18. Exhaust gas turbocharger according to claim 16, wherein the vanes are adapted to either fully enter into the free diffuser passage or leave it completely open.

19. Exhaust gas turbocharger according to claim 16, wherein exhaust gas can be fed through an exhaust gas return device to the pressure side of the radial compressor.

* * * * *